US006412781B1

(12) United States Patent
Lund

(10) Patent No.: US 6,412,781 B1
(45) Date of Patent: Jul. 2, 2002

(54) VOCABULARY WORD GAME

(76) Inventor: Richard Lund, N. 2681 830th St., Hager City, WI (US) 54014

( * ) Notice: Subject to any disclaimer, the term of this patent is extended or adjusted under 35 U.S.C. 154(b) by 0 days.

(21) Appl. No.: 09/550,957

(22) Filed: Apr. 17, 2000

(51) Int. Cl.[7] ..... A63F 1/00
(52) U.S. Cl. ..... 273/299; 273/272
(58) Field of Search ..... 273/292, 293, 273/299, 302, 272

(56) References Cited

U.S. PATENT DOCUMENTS

| | | | | |
|---|---|---|---|---|
| 742,498 | A | | 10/1903 | Roy |
| 977,117 | A | | 11/1910 | McPherson |
| 1,332,249 | A | | 3/1920 | Feero |
| 2,091,555 | A | * | 8/1937 | Messinger |
| 2,265,334 | A | | 12/1941 | Armbruster |
| 2,783,998 | A | | 3/1957 | Collins |
| 3,333,351 | A | * | 8/1967 | Williams |
| 4,026,558 | A | * | 5/1977 | Patin |
| 4,204,343 | A | * | 5/1980 | Brooks |
| 4,299,391 | A | * | 11/1981 | Silver |
| 5,106,103 | A | | 4/1992 | Fiore |
| 5,207,435 | A | * | 5/1993 | Tanner |
| 5,417,432 | A | | 5/1995 | Dwyer |
| 5,657,994 | A | * | 8/1997 | O'Connor |
| 5,788,238 | A | * | 8/1998 | LeBriton et al. |

* cited by examiner

*Primary Examiner*—Benjamin H. Layno
*Assistant Examiner*—Vishu K Mendiratta
(74) *Attorney, Agent, or Firm*—Tipton L. Randall

(57) ABSTRACT

A collection of playing pieces for a vocabulary word game is disclosed. The pieces contain on one face a multi-letter combination of at least two letters plus a designator indicating required location of the letter combination in words. During a playing interval one playing piece is displayed to all players. Each player writes a list of words containing the selected letter combination at the designated location in the words. After a predetermined time limit the players reveal their list to all. The winner of the playing interval is the player with the greatest number of words on their list. The game continues for a chosen number of intervals, the game winner being the player winning the greatest number of individual playing intervals.

5 Claims, 2 Drawing Sheets

VOCABULARY WORD GAME

BACKGROUND OF THE INVENTION

1. Field of the Invention.

The present invention relates to a set of playing pieces used in a vocabulary word game, as well as a method of play for the word game.

2. Background Information.

There are many methods of improving the vocabulary for an individual. Activities such as reading and writing are useful in this regard, and are often practiced in elementary and high schools. These school work activities are often not appealing to students and viewed as drudgery. If such activities can be incorporated into a game or similar competition, students and adults are more likely to participate, thereby improving their language skills. Various printed indicia such as letters, numbers or pictorial displays have been imprinted on cards, tiles, and the like for use in a wide variety of word games that have become popular.

Some examples of inventions concerned with word games using cards or tiles having letters, numerals and/or pictures are found in the following patents. Roy, in U.S. Pat. No. 742,498, describes a card game with cards containing single, double or triple letters, plus pictorial or descriptive matter. Cards are played to spell the name of a famous person.

In U.S. Pat. No. 1,332,249, Ferro discloses a deck of 52 cards, each with two letters of the alphabet plus numbers corresponding to the position of each letter in the alphabet. Players in turn try to spell words by placing one card face up and building on earlier played cards. Either of the two letters on a card may be used in spelling a word.

Armbruster, in U.S. Pat. No. 2,265,334, describes a large deck of cards with each card having one, two or three letters plus a numerical value. Cards are also colored either red, white or blue. Players spell words by combining cards and receive a score equal to the numerical total from the card numbers used for spelling the word.

In U.S. Pat. No. 2,783,998, Collins discloses a large deck of cards, having a two letter combination on each card. Players again try to spell words by combining cards and can use either one or both letters from a card to spell a word. In this game players must combine multiple cards to spell just one word.

Patin, in U.S. Pat. No. 4,026,558, discloses a word-spelling game using a collection of lettered tiles. The face of each tile is marked with two letters of the alphabet such that each letter is recognized as being from one of two sets (e.g. red & black). Some tiles are marked with two different letters and others are marked with two identical letters. The game is played similarly to dominos where the tiles are placed in a specified sequence on a surface. In this game, a word must be formed by adjacent letters from the same set, that is, the red or black letters must spell out a word.

Silver, in U.S. Pat. No. 4,299,391, describes a word spelling game which has two sets of tiles, with each tile having two letters plus an orientation arrow. The players alternate turns and place one or more tiles from their set on a surface in abutted positions. The tiles must spell one or more words when tracing the orientation arrows from one tile to the next. A "wild letter" tile is also employed to be designated a specific letter pair by either player. No time limit is mentioned.

In U.S. Pat. No. 5,106,103, Fiore discloses an initial game where two columns of letters are generated by the random positioning of cubes having letters on the cube surface. The players then write on a game card the names of famous persons having the two initials shown for each row of the two columns. The players are give a set time interval to record their answers on the game card.

U.S. Pat. No. 5,417,432 by Dwyer describes an alphabet playing card deck having 56 standard size playing cards. Each card has one letter of the alphabet with two cards for each letter, totaling 52 cards. The four remaining cards can be wild cards or written game playing instruction cards. Additionally, the cards may contain a picture of an object that begins with the letter on that specific card. The cards can be arranged and combined in matching letter recognition games, in alphabetic letter sequence racing game and in simple word-forming games.

Nearly all of these games require the players to spell out words using combinations of the cards or tiles each containing one or more letters. This generally requires a large number of playing pieces for a game, particularly if there are more than four to six players participating in the game. Thus, there is a need for a vocabulary word game where many players can participate with a minimum of required playing pieces.

SUMMARY OF THE INVENTION

The invention is directed to a collection of playing pieces used in a vocabulary word game, as well as a method of playing the vocabulary word game, where players list as many words as possible having a specified multi-letter combination within a set time period. The multi-letter combinations are those commonly found in English language words and are each printed on one face of a collection of playing pieces such as a set of cards. The playing piece also includes a designator indicating the required location of the multi-letter combination in words. The multi-letter combinations, for example the two letter combination TH, are further designated on each playing piece as being the first (two) letters of a word.(TH—, e.g. thing), the last (two) letters of a word (—TH, e.g. width), contained within the word but neither first nor last letters (—TH—, e.g. brother), or present at any position in a word (TH*, any of the above three options and associated words). Three or four letter combinations may also be included, each with an associated designator (—ICH, e.g. which, PRES*, e.g. president, express).

The game consists of a defined number of playing intervals (e.g. 8 rounds). The playing pieces are shuffled and one piece is drawn and turned face up for all players to see. Each player then writes on their word pad as many words containing the properly positioned specified multi-letter combination as he/she is able during a set time period (e.g. 1 minute). The lists are reviewed by all players for accuracy and the player with the greatest number of words wins that playing interval. Another playing piece is drawn from the collection for each succeeding interval and the routine is repeated until the defined number of playing intervals is completed. The player winning the greatest number of playing intervals is the game winner. The number of players can vary from 2 to 12 or more.

DESCRIPTION OF THE PREFERRED EMBODIMENTS

Nomenclature

10 Planar Playing Pieces

15 Cards

20 Tiles

25 Multi-letter Combination

30 Designator

Figure 1:
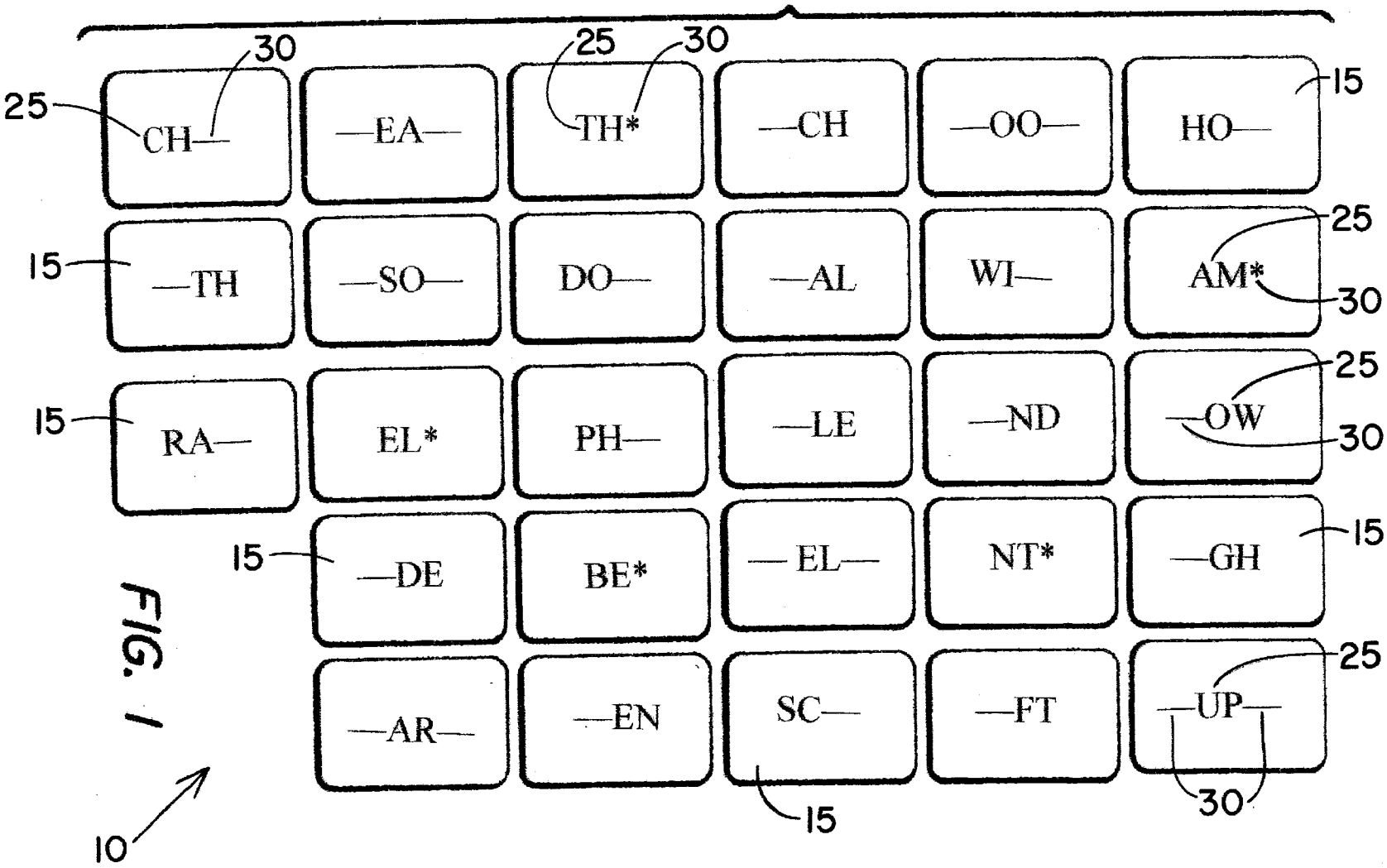
FIG. 1 is a perspective view of a preferred embodiment of the planar playing pieces of the present invention.
Figure 2:
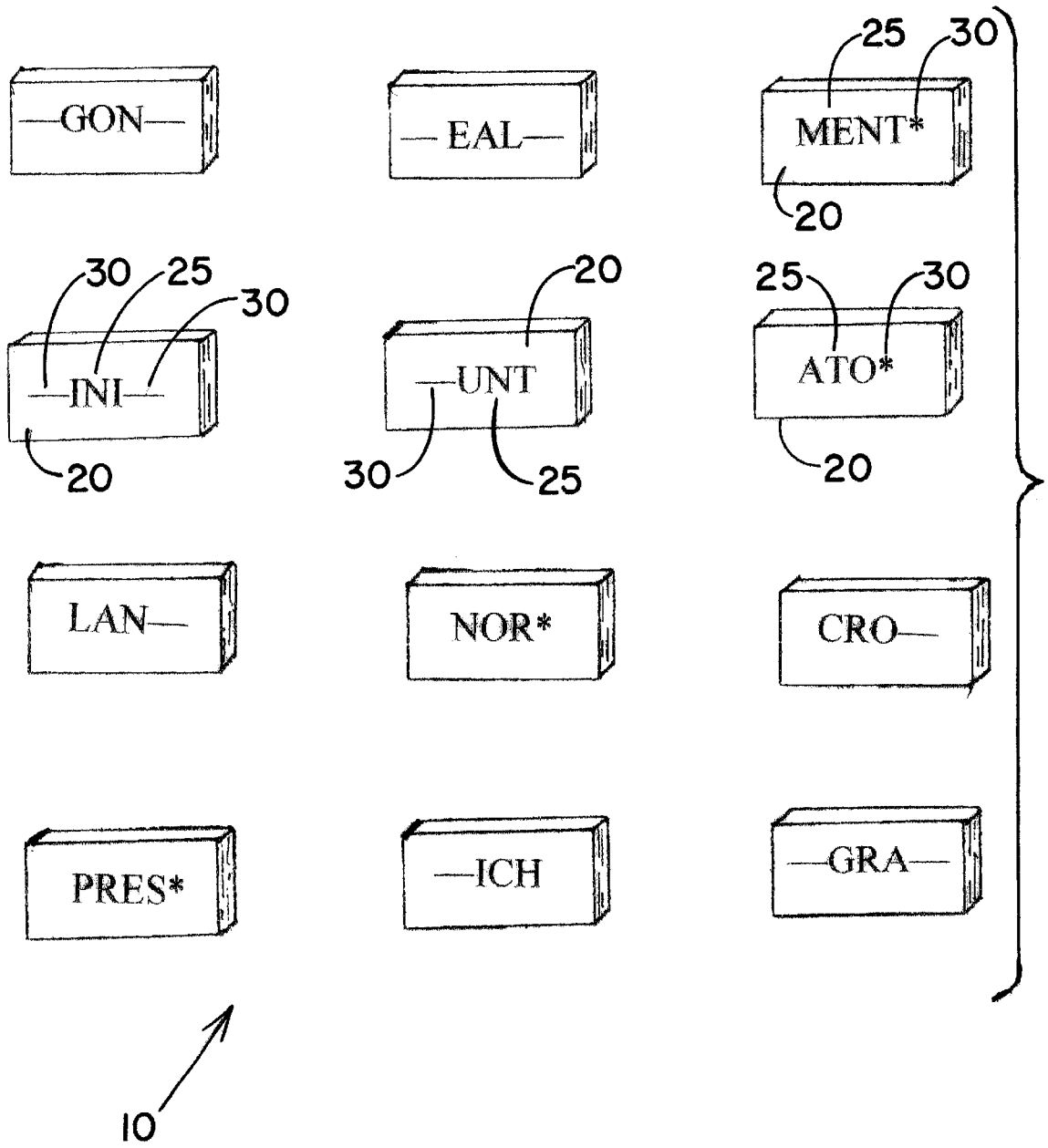
FIG. 2 is a perspective view of another embodiment of the planer playing pieces of the present invention.

Referring to FIGS. 1 and 2, two embodiments of a collection of planar playing pieces 10 employed in the vocabulary word game of the present invention are shown. The planar playing pieces 10 may be cards 15 or tiles 20 respectively. Each planar playing piece 10 displays on one face a multi-letter combination 25 of at least two letters plus a designator 30 that indicates the required location of the multi-letter combination 25 in English language words. The designator 30 may be one or two dash indicia that precede or follow the multi-letter combination 25, or may be an asterisk (*) following the multi-letter combination 25. For example, the two letter combination "TH" may be designated playing piece 10 as being the first two letters of a word by the notation "TH—" (e.g. thing), the last two letters of a word by the notation "—TH" ( e.g. width), contained within a word but neither first nor last letters by the notation "—TH—" (e.g. brother). The dash indicia denote the location of at least one more additional letter in solution words. Alternatively, the designator 30 may be an asterisk indicia (*) following the letter combination, in this example the notation "TH* " indicating the letter combination may be located at any position within solution words (e.g. any of the above three options and associated words). Three or four letter combinations 25 may also be included on the playing pieces 10, each with an associated designator 30. For example, the notation "—ICH" is satisfied by the words which or sandwich and the notation "MENT* " by the words mentor, ornamental or placement.

As can be appreciated, the multi-letter combination 25 plus one of four possible designators 30 gives rise to an enormous number of possible notations. A two letter combination 25 with four possible designators 30 results in a total of 2,704 possible notations. Increasing the multi-letter combination 25 to three letters plus four possible designators 30 results in 210,912 possible unique notations, while including a four letter combination 25 plus four possible designators 30 results in over 20 million such unique notations. The multi-letter combinations 25 on the playing pieces 10 are selected from those letter combinations commonly found in English language words. Those multi-letter combinations 25 that are seldom or never found in English language words are not selected.

In a preferred embodiment of the invention, the multi-letter combinations 25 selected for the playing pieces 10 are limited to two-letter combinations, and the preferred playing pieces 10 are cards 15. The preferred embodiment is shown in FIG. 1 where a representative selection of two-letter combinations 25 with a designator 30 on cards 15 is seen. Generally, the two-letter combinations 25 with one of the four possible designators 30 gives rise to the greatest number of solution words, compared to the three-letter or four-letter combinations.

FIG. 2 shows an alternative embodiment of the invention where the multi-letter combinations 25 selected for the playing pieces 10 are three-letter or four-letter combinations with an associated designator 30, and the playing pieces 10 are tiles 20. Again, only a representative selection of three-letter and four-letter combinations are shown in FIG. 2.

The game requires at least two players while up to twelve or more players can participate with ease. For purposes of explanation, the playing pieces 10 are considered to be cards 15 each displaying on one face a multi-letter combination 25 of at least two letters plus a designator 30 that indicates the required location of the multi-letter combination 25 in English language words. The playing pieces 10 can be tiles 20 with equivalent results. The cards 15 are shuffled and placed face down in a stack. In a first playing interval, one player selects one card 15 from the stack of cards 15 and displays the multi-letter combination 25 plus designator 30 on the card face to all players. Each player simultaneously and independently records words containing the multi-letter combination 25 at the required location on a tally sheet to produce a first word list. A timing device is used to set a time limit, for instance one minute, for recording the words. After the predetermined time limit the players reveal their tally sheet first word list to all players. Each word on each list is reviewed for accuracy with the multi-letter combination 25 and designator 30 displayed on the upturned card 15. The winning player for the first playing interval is determined by the tally sheet first word list having the greatest number of correct words recorded thereon. Another card 15 is then drawn from the stack and the steps described above are repeated a second time with a winner determined for the second playing interval. A predetermined number of successive playing intervals follow, for instance eight intervals. A game winner is determined by the player winning the greatest number of playing intervals.

The game of the present invention encourages vocabulary building skills in the players. In verifying that a particular word on a word list is spelled correctly, the players sharpen their spelling ability as well.

While the invention has been particularly shown and described with reference to preferred embodiments thereof, it will be understood by those skilled in the art that various changes in form and details may be made therein without departing from the spirit and scope of the invention.

What is claim is:

1. A collection of planar playing pieces each displaying on one face a multi-letter combination of at least two consecutive letters plus a designator indicating a required location of said multi-letter combination in words, said designator selected from the group comprising one dash indicia, two dash indicia, and an asterisk, said dash indicia denoting location of at least one additional letter in words, and said asterisk indicating said multi-letter combination is present at any location in words.

2. The collection of planar playing pieces of claim 1 wherein said playing pieces are cards.

3. The collection of planar playing pieces of claim 1 wherein said playing pieces are tiles.

4. The collection of planar playing pieces of claim 1 wherein said multi-letter combination is selected from the group comprising two consecutive letters, three consecutive letters and four consecutive letters.

5. The collection of planar playing pieces of claim 1 wherein said multi-letter combination comprises two consecutive letters.

* * * * *